US010249132B2

(12) United States Patent
Hutchinson-Kay et al.

(10) Patent No.: US 10,249,132 B2
(45) Date of Patent: Apr. 2, 2019

(54) ARCHITECTURE FOR MULTI-PLAYER, MULTI-GAME, MULTI-TABLE, MULTI-OPERATOR AND MULTI-JURISDICTION LIVE CASINO GAMING

(71) Applicant: NET ENTERTAINMENT NE AB, Stockholm (SE)

(72) Inventors: Christer Hutchinson-Kay, Täby (SE); Per Eklund, Sundbyberg (SE); Per Anders Larsson, Vallentuma (SE); Per Larsson, Ingarö (SE); Anders Fredriksson, Täby (SE); Martin Wennerberg, Huddinge (SE); Niclas Åström, Umeå (SE); Ulf Bertilsson, Umeå (SE)

(73) Assignee: NETENT PRODUCT SERVICES LTD., Ta'xbiex (MT)

( * ) Notice: Subject to any disclaimer, the term of this patent is extended or adjusted under 35 U.S.C. 154(b) by 355 days.

(21) Appl. No.: 14/439,596

(22) PCT Filed: Oct. 28, 2013

(86) PCT No.: PCT/EP2013/072541
§ 371 (c)(1),
(2) Date: Apr. 29, 2015

(87) PCT Pub. No.: WO2014/067911
PCT Pub. Date: May 8, 2014

(65) Prior Publication Data

US 2015/0302690 A1 Oct. 22, 2015

Related U.S. Application Data

(60) Provisional application No. 61/719,554, filed on Oct. 29, 2012.

(51) Int. Cl.
*G07F 17/32* (2006.01)

(52) U.S. Cl.
CPC ..... *G07F 17/3223* (2013.01); *G07F 17/3211* (2013.01); *G07F 17/3225* (2013.01);
(Continued)

(58) Field of Classification Search
CPC .. G07F 17/32; G07F 17/3202; G07F 17/3211; G07F 17/322; G07F 17/3216
(Continued)

(56) References Cited

U.S. PATENT DOCUMENTS 6,508,709 B1 * 1/2003 Karmarkar ..... G07F 17/32 463/40
7,429,117 B2 * 9/2008 Pohlert ..... H04N 5/2354 348/E5.029
(Continued)

FOREIGN PATENT DOCUMENTS

GB 2321565 A 7/1998
GB 2484594 A 4/2012
(Continued)

OTHER PUBLICATIONS

Communication Pursuant to Article 94(3) EPC from European Application No. 13785414.7 dated Feb. 9, 2017 (6 pages).
(Continued)

*Primary Examiner* — William H McCulloch, Jr.
*Assistant Examiner* — Chase E Leichliter
(74) *Attorney, Agent, or Firm* — Calfee Halter & Griswold LLP

(57) ABSTRACT

Methods and systems for enabling network based live casino gaming, wherein a game user o) is enabled to participate from a remote location by a game user device in a live casino game operated by a casino operator, the system comprising a studio being configured for performing and recording live
(Continued)

casino gaming; a data integration center being configured for integrating data pertaining to a casino game performed in the studio with game user specific data and casino operator specific data; an audio/video streaming provider data center configured for receiving live casino game audio/video data streams from the said studio, for generating casino operator specific audio/video data streams by mixing said live casino game audio/video data streams with casino operator specific content, and for providing said generated casino operator specific audio/video data streams to a game user device of a game user.

12 Claims, 7 Drawing Sheets

(52) U.S. Cl.
CPC ..... *G07F 17/3237* (2013.01); *G07F 17/3272* (2013.01); *G07F 17/3288* (2013.01)

(58) Field of Classification Search
USPC ..... 463/42, 47
See application file for complete search history.

(56) References Cited

U.S. PATENT DOCUMENTS

2001/0003099 A1* 6/2001 Von Kohorn ..... H04N 7/0884 463/40
2003/0003997 A1 1/2003 Vuong et al.
2005/0020358 A1* 1/2005 Cram ..... G07F 17/32 463/31
2005/0054440 A1 3/2005 Anderson et al.
2005/0099603 A1 5/2005 Thomas et al.
2005/0099824 A1* 5/2005 Dowling ..... A61B 1/0653 362/572
2005/0128751 A1* 6/2005 Roberge ..... F21K 9/00 362/276
2005/0174473 A1* 8/2005 Morgan ..... F21S 48/325 348/370
2006/0002110 A1* 1/2006 Dowling ..... F21K 9/00 362/249.05
2006/0022214 A1* 2/2006 Morgan ..... F21K 9/00 257/99
2006/0098286 A1* 5/2006 Sagar ..... G02B 5/128 359/530
2006/0114356 A1* 6/2006 Didow ..... G03B 15/07 348/587
2007/0236586 A1 10/2007 Rychkman
2008/0220849 A1* 9/2008 Wadleigh ..... G07F 17/32 463/20
2009/0238378 A1* 9/2009 Kikinis ..... H04N 13/0497 381/92
2009/0303593 A1* 12/2009 Sagar ..... G02B 5/124 359/546
2010/0137064 A1* 6/2010 Shum ..... A63F 13/06 463/36
2010/0293190 A1 11/2010 Kaiser et al.
2011/0111862 A1 5/2011 Allen et al.
2011/0157297 A1* 6/2011 O'Connell ..... G03B 15/02 348/14.07
2012/0094737 A1* 4/2012 Barclay ..... G07F 17/3213 463/20
2013/0243248 A1* 9/2013 Vonolfen ..... H04N 5/2224 382/103
2013/0281188 A1* 10/2013 Guinn ..... G07F 17/323 463/25

FOREIGN PATENT DOCUMENTS

WO 2000079467 A2 12/2000
WO WO 0079467 A2 * 12/2000 ..... G07F 17/32
WO 2004105458 A2 12/2004
WO 2007143202 A2 12/2007
WO WO 2012038009 A1 * 3/2012 ..... H04N 5/2224

OTHER PUBLICATIONS

International Search Report from PCT/EP2013/072541 dated Apr. 9, 2014.
Written Opinion from PCT/EP2013/072541 dated Apr. 9, 2014.
International Preliminary Report on Patentability from PCT/EP2013/072541 dated Feb. 19, 2015.
Response to Written Opinion from PCT/EP2013/072541 dated Feb. 3, 2015.
Written Opinion from PCT/EP2013/072541 dated Dec. 3, 2014.
Informal Comments on Written Option and Claim Amendments from PCT/EP2013/072541 dated Oct. 31, 2014.
Grau O et al., "A Combined Studio Production System for 3-D Capturing of Live Action and Immersive Actor Feedback," IEEE Transactions on Circuits and Systems for Video Technology, Vol. 14, No. 3, Mar. 3, 2004.

* cited by examiner

ARCHITECTURE FOR MULTI-PLAYER, MULTI-GAME, MULTI-TABLE, MULTI-OPERATOR AND MULTI-JURISDICTION LIVE CASINO GAMING

TECHNICAL FIELD

The present invention pertains in general to the technical field of systems and methods for enabling multi-player, multi-table, multi game operator and multi-jurisdiction live casino gaming.

A particular aspect of the inventive concept is directed to a system architecture for enabling scalable multi-player, multi-table, multi game operator and multi-jurisdiction live casino gaming.

Another particular aspect of the inventive concept is directed to enhancing content switching in a game user device.

Another particular aspect of the inventive concept is directed to enabling game user and game operator specific customization of the network based live casino content in a game user device.

Another particular aspect of the inventive concept is directed to improving access to other casino gaming devices while taking part in a network based live casino game.

Another particular aspect of the inventive concept is directed to making more efficient use of equipment, in an audio/video streaming provider data center.

Another particular aspect of the inventive concept is directed to enhancing sound recording in a micro studio Another particular aspect of the inventive concept is directed to reduce error probability when monitoring game play in a network based live casino Another particular aspect of the inventive concept is directed to reducing energy consumption when recording in a micro studio

BACKGROUND

Gambling is an increasingly popular activity and is growing in number of participants globally. In particular, games available at casinos are receiving more and more attention. Casino games normally involve a game leader, such as a dealer or croupier, a gaming device and players.

In order to facilitate the opportunity to participate in casino games for players unable or unwilling to travel to a casino, network based non-live casinos have been introduced. In a network based non-live casino the game user interacts with a system where the casino environment is animated and oriented towards game user versus system gaming.

To further enhance the player experience live casino gambling has been introduced, where part of the content presented to a game user is live and part of the content presented to a game user is animated. The live part of the content comprises physical persons interacting with physical gaming devices and recording the interaction in a micro studio located in a larger studio. To facilitate multiple players multiple micro studios are located within a larger studio.

The environment of a network based live casino differs significantly from the setting of a normal casino. The players at a live network based casino use a player client to communicate with the network based live casino and could be located anywhere where they can access a communications network, e.g. the internet. The live content is produced in a studio that comprises multiple instances of a game leader, a gaming device and recording equipment for recording game play. The live network based live casino also comprises control logic to handle game users, predefined content and live content. In addition the system comprises at least a node for each casino operator hosting game user accounts and winnings/earnings information.

A problem is that creating a network based live casino environment in conventional systems involves complex adaption and integration of the studio and control logic, which in prior art solutions must be repeated if additional network based non-live casino operators are to be supported by the same studio, if the number of game users increase or if additional games allowed under other jurisdictions are to be made available to game users. This seriously reduces the flexibility, scalability and the selection of live casino games Another consideration is that the game logics geographical location determines the jurisdiction, each having its own set of requirements for technology and business processes to which the game server operation must comply to.

Another problem is that the allocation of game users to gaming devices and casino operators are static.

One of the purposes of the present invention is to reduce complexity and improve scalability when adding live casino games, game users, game operators and gaming devices in a system comprising a studio comprising multiple micro studios and control logic.

When presenting live content pertaining to different aspects of game play, such as different aspects view or camera angles of the recording equipment, to the game user the switching causes delay when switching between different content streams. If content of different aspects are streamed in parallel it requires additional bandwidth.

One of the purposes of the present invention is to reduce delay and reduce bandwidth requirements when switching between different aspects of game play.

A problem when supporting multiple game users associated with multiple casino operators by a single studio, comprising multiple micro studios, is that the same content is presented to all game users regardless of their association to a casino operator.

One of the purposes of the present invention is to customize the content presented to a game user depending on the game users association to a casino operator.

A problem when a game user taking part in a network based live casino game on a first gaming device wants to take part in or monitor the progress of a network based live casino game on a second gaming device is that this involves leaving the game on the first gaming device and entering a game on the second gaming device.

One of the purposes of the present invention is to facilitate an improved way for a game user taking part in a network based live casino game on a first gaming device to monitor or take part in the network based live casino game on a second gaming device, thereby improving the gaming experience.

In a network based live casino with multiple game devices associated with multiple casino operators a large amount of equipment resources must be allocated, as at least one equipment unit has to be assigned to a gaming device for each casino operator associated to the gaming device.

One of the purposes of the present invention is to make more efficient use of equipment to support multiple casino operators associated to a gaming device.

A problem is when recording audio associated with a gaming device in a micro studio background noise such as sounds associated to other micro studios is also recorded. This results in degraded audio quality and reduced game user experience.

One of the purposes of the present invention is to achieve enhanced audio recording in a micro studio A problem when performing game play in a micro studio 350 is that there might be occurring discrepancies between the physical game play result and the result recorded by the control logic. The game leader might acknowledge that the results are correct, but this repetitive action might result in additional discrepancies when erroneous game play is acknowledged or when correct game play is not acknowledged.

One of the purposes of the present invention is to reduce error probability when monitoring game play in a network based live casino.

A problem when recording game play in a network based live casino is that the recording equipment in a micro studio requires additional lighting to maintain the quality of recording. In a micro studio environment parts of the energy used for lighting will heat up objects in the micro studio that in turn will put additional requirements on air conditioning facilities, in particular in a micro studio where reducing the footprint is important.

One of the purposes of the present invention is to save energy and reducing heat generation in a micro studio environment.

These and other considerations have been addressed by the current invention, which is described more fully below in the description. Additional benefits and advantages of the current invention will be given below or will be apparent from the nature of the invention.

Conventional Systems

Examples of conventional systems are found in the following documents:

EP0956118 B1 describes a method by which a player may participate in a live casino game from a location remote from the casino is disclosed. A player establishes an information link with a casino from an interface station including a video monitor and keypad. In response to the player's entry of financial account information, the casino establishes an information line with the player's financial institution. The casino assigns the player to a gaming table at which a "live" game is occurring, transmitting all images of game play and instructions to the player. The player transmits bet and game play information to the casino. Because of the open line between the casino and player's financial institution, bets are checked, winnings paid, and losses debited, instantaneously US 2012/0094737 A1 describes a wagering game system. In embodiments, the operations can include receiving a live video feed of a game event such as an image of a slot wagering game, a roulette game, a poker game, a sporting event, etc. The operations can further r include compositing the live video feed with an additional image and including the live video feed in a webpage for a wagering game website. The operations can further include determining an event that occurs during the live video feed and causing the additional image to appear react or interact with images depicted in the live video feed. The operations can further include triggering a secondary wagering game and further compositing images from the secondary wagering game with the video feed.

US 2011/0271208 A1 describes a method for providing a virtual conference is described. The method includes a conferencing system that configures a virtual conference location; the conferencing system playing a personalized sound effect corresponding to generating a graphical representation of a conference participant; and the conferencing system displaying the graphical representation of the conference participant in the virtual conference location. The method further includes the conferencing system displaying a graphical user interface that lists one or more entertainment options and the conferencing system receiving one or more selections from the graphical user interface. The method further includes displaying visuals corresponding to one or more of the selections.

US 2009/0291762 A1 describes gambler's gaming experience is extended outside the traditional gaming environment by providing a remote gaming environment that duplicates the sights, sounds, smells, and experience of a traditional casino floor. The remote gaming environment may be networked into a customer service center to help resolve issues and prevent fraud.

US 2008/0075436 A1 describes a studio booth is configured to produce the illusion that a customer is being photographed at a different locale remote from the studio booth.

However, none of the related art discloses the solutions of the present invention.

SUMMARY

The inventive concept is directed to reducing complexity when integrating a studio comprising multiple micro studios, control logic and casino operators.

Essential to the invention is that the need for complex integration is reduced when adding game users, game operators, game devices or live casino games to the system. This is achieved by separating recording of game play in a studio, generation of casino operator specific audio/video data streams to a game user in an audio/video streaming provider data center, executing game related logic in a data integration center and handling interaction with the user in a game user client. The audio/video data streams are synchronized with game related information pertaining to gaming activity in the game user client by the use of cuepoints present in the operator specific audio/video data streams.

As the scalable studio, audio/video streaming provider data center and the data integration center are shared by game operators additional operators may be added through configuration of the existing system instead of performing complex integration, as would be the case in conventional systems.

As users associated with different game operators may share the same gaming device but are presented with casino operator specific audio/video data streams the utilization of each gaming device may be increased and the number of gaming devices may be reduced in comparison to a conventional system. I.e. users associated to multiple operators are in a matter of speaking "multiplexed" on the gaming devices thereby achieving a "trunking" effect.

As users associated with different game operators may be provided with casino operator specific audio/video data streams in the audio/video streaming provider data center the equipment in said audio/video streaming provider data center may be reduced in comparison to a conventional system. I.e. users associated to multiple operators are in a matter of speaking "multiplexed" over the equipment thereby achieving a "trunking" effect.

As the system may comprise multiple data integration centers located in various jurisdictions, allowing particular live casino games, enables operators to offer additional live casino games to associated users without complex integration.

The solution is realized in different embodiments to support live, real-time multiplayer, multi-gaming device gaming, multiple casino operators and multiple jurisdictions in a scalable platform.

DETAILED DESCRIPTION

The inventive concept relate to systems and methods for multi-player, multi-table, multi game operator and multi-jurisdiction live casino gaming.

The inventive concept comprises embodiments of the invention that is directed to enabling scalable multi-player, multi-table, multi game operator and multi-jurisdiction live casino gaming.

The inventive concept comprises embodiments of the invention that is directed to reducing delay and reduce bandwidth requirements when switching between different aspects of game play.

The inventive concept comprises embodiments of the invention that is directed to customizing the content presented to a game user depending on the game users association to a casino operator.

The inventive concept comprises embodiments of the invention that is directed to improving access to other casino gaming devices while taking part in a network based live casino game.

The inventive concept comprises embodiments of the invention that is directed to achieving enhanced audio recording in a micro studio The inventive concept comprises embodiments of the invention that is directed to reducing error probability when acknowledging game play in a network based live casino.

The inventive concept comprises embodiments of the invention that is directed to saving energy and reducing heat generation in a micro studio environment.

Architecture Overview

Figure 1:
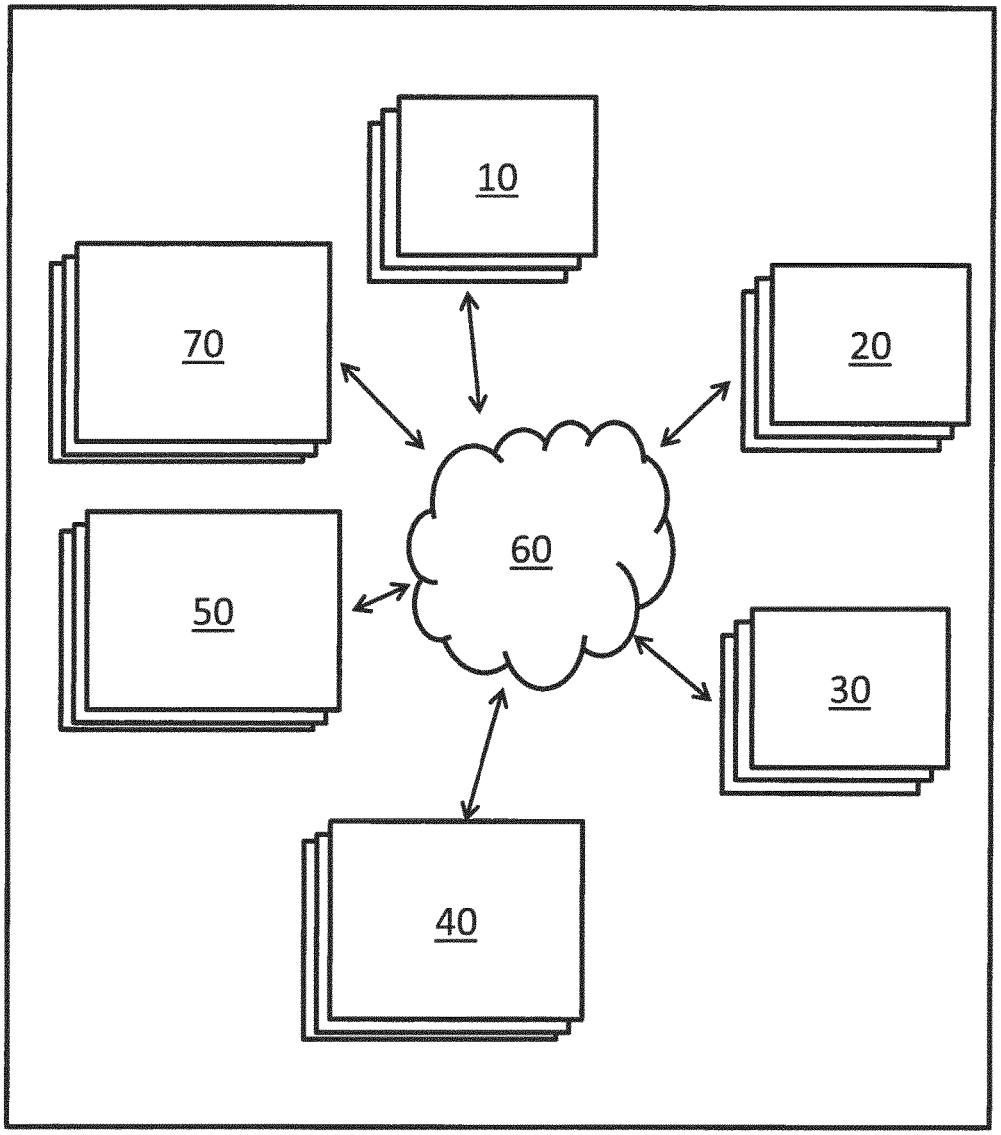
FIG. 1 describes an embodiment of an architecture configured to support live, real-time multiplayer, multi-gaming device gaming, multiple casino operators and multiple jurisdictions in a scalable platform.

FIG. 1. describes an embodiment of the invention comprising a network architecture for enabling playing of network based live casino games.

A general embodiment of an architecture according to the inventive concept is realized as a system for enabling network based multi-player, multi-table, multi game operator and multi-jurisdiction live casino gaming, wherein a game user (210) is enabled to participate from a remote location (10) in a live casino game operated by a casino operator (70). This system in one example comprises:

a studio (20) being configured for performing and recording live casino gaming;

a data integration center (30) being configured for integrating data pertaining to a casino game performed in the studio with game user specific data and casino operator specific data;

an audio/video streaming provider data center (40) configured:

for receiving live casino game audio/video data streams from the said studio, for generating casino operator specific audio/video data streams by mixing said live casino game audio/video data streams with casino operator specific content, and for providing said generated casino operator specific audio/video data streams to a game user device (260) of a game user (210);

a predefined content delivery center (50) configured for delivering predefined content to the game user device (260).

In one embodiment said a game user device (260), said studio (20), said data integration center (30), said audio/video data streaming provider data center (40), said related predefined content delivery center (50), said casino operator (70) server are communicatively enabled via a data communications network (60).

In one embodiment the players or game users 210 are participating in a live casino game operated by a casino operator 70 at a remote location 10 through a game user client 250 running on a game user device 260, wherein the game user device 260 is communicatively coupled with other nodes in the system and communicating via a communications network 60.

In one embodiment the architecture comprises a physical studio 20, where live casino gaming activity is performed within a micro studio by a game leader. Audio/video related to the game activity is recorded, integrated and communicated to the audio/video data streaming provider data center 40 via the communications network (60). Game related information pertaining to gaming activity occurring in the micro studio is communicated to the audio/video data streaming provider data center (40) and to the data integration center (30) via said communications network (60).

In one embodiment processors, e.g. servers, in the studio 20 communicates with other nodes, e.g. nodes located at the remote location 10, the studio 20, the data integration center 30, the audio/video data streaming provider data center 40, the predefined content delivery center 50 and the casino operator 70, through the communications network 60, for example by sending and receiving information, e.g. game related information pertaining to gaming activity occurring in the micro studio, and streaming the recorded live game video and audio feeds.

In one example the game leader is operating a gaming device, such as a live gaming equipment (LGE) adapted to live gaming. Audio/video, e.g. of the game leader operating the roulette wheel is recorded and integrated to a data stream, associated with the gaming device, to the audio/video data streaming provider data center (40) where casino operator specific information or content, such as a background, is mixed with the recorded audio/video. Game related information pertaining to gaming activity occurring in the micro studio, e.g. result of the roulette wheel spin, time to spin the roulette wheel and time for "no more bets" and indication of an erroneous game round, are sent to the audio/video data streaming provider data center (40) and to the data integration center (30) via said communications network (60). The audio/video data streaming provider data center (40) use the information pertaining to gaming activity occurring in the micro studio to insert synchronization information, called cuepoints, into the generated audio/video stream in so that the game user client can synchronize the audio/video stream with game events displayed by the game user client, e.g. animations of game actions. Cue points may be invisible markers in a video file which can be used to trigger external events, e.g. to synch video streams and game events in a game user client.

In one embodiment the architecture comprises a data integration center 30, comprising one or more processors, for example devices or servers. The data integration center (30) is configured for integrating data pertaining to a casino game performed in the studio with game user specific data and casino operator specific data, wherein the data integration center 30 and the processors within the data integration center 30 are communicatively coupled to the communications network 60. In one embodiment the processors are adapted with computer program code portions configured to direct a processor to perform the steps and functions of the system described herein In one embodiment the servers in the data integration center 30 is responsible for handling game users 210, e.g. sending/receiving information to/from game user/player clients 250 executing on game user devices 260, handling live casino game statistics reporting and processing, e.g. results from game rounds, handling game logic, e.g. processing information such as events to determine the results in live casino games based on game related information pertaining to gaming activity, such as events, handling game user account information and transfer of winnings, e.g. login information, services available to the game user and transfer of credit information. Servers within the data integration center 30 is communicatively coupled to other nodes, e.g. servers located at the remote location 10, the studio 20, the data integration center 30, the audio/video, through the communications network 60.

In one embodiment all communicatively coupled nodes, e.g. servers located at the remote location 10, the studio 20, the data integration center 30, the audio/video, communicate using secure communication methods.

In one embodiment the secure communication methods involve that all data transferred between servers and devices is encrypted.

In one example the data integration center 30 receives information pertaining to gaming activity occurring in the studio, such as game device results, information pertaining to gaming activity occurring at the game user device 260, such as placing bets, determine the gaming effects of these activities by executing game logic, e.g. determine if a game round is complete and if a game user is the winner or not, and transfer information pertaining to gaming effects to the studio 20, such as instructions to the game leader that a particular user is a winner, and the game user device 260. Optionally the information pertaining to gaming effects is used to generate statistics reports and store statistics in a non-volatile storage device. Optionally the information pertaining to gaming effects is used to trigger transactions of winnings/earnings associated with a game user to a casino operator 70.

In one example the data integration center 30 receives information pertaining to gaming activity occurring in the studio, information pertaining to gaming activity occurring at the game user device 260, determine the gaming effects of these activities by executing game logic and performs game user 21 account transactions or handling transfer of winnings/earnings between the game users 21 and associated casino operator 70.

In one example game user 21 account transactions comprises any of login information, game user profile information and service availability for a particular game user In one example game user 21 winnings/earnings comprises a measure of credit the user can use to play the live casino games.

In one embodiment the architecture comprises an audio/video streaming provider data center (40) configured for receiving live casino game audio/video data streams from the studio 20, for generating casino operator specific audio/video data streams by mixing said live casino game audio/video data streams with casino operator specific content, and for providing said generated casino operator specific audio/video data streams to a game user device (260) of a game user (210);

In one embodiment the audio/video data streaming provider data center 40 is responsible for receiving and decoding multiple streams of a first content, e.g. live video and audio feeds each associated to a gaming device 311, from the studio 20, obtaining a second content from a content generator 680, generating a third content by mixing the first content and the second content, encoding the third content and simultaneously injecting information pertaining to gaming activity occurring in the studio, e.g. cuepoints, into the encoded content for later use by the user equipment 260 to synchronize the content with gaming activity in the studio and communicating the encoded third content via the communications network 60 to other nodes, e.g. servers or devices located at the remote location 10, the studio 20, the data integration center 30, the audio/video, In one embodiment the second content is static content, such as a locally stored image In one embodiment the second content is dynamic content, e.g. live video and audio feeds or predetermined audio and video feeds.

In one embodiment the encoded third content is communicated to game user devices 260 and processed by game user clients 250.

In one example an integrated audio/video data stream associated with a particular gaming device is received as a first content, operator specific second content is obtained e.g. a locally stored image, a video stream received by the content generator 680 or local animations generated by the content generator 680, the first and second content is mixed to generate a third content. The third content is encoded and simultaneously information pertaining to gaming activity of the associated device is injected into the third content thereby generated an encoded third content. The encoded third content is sent via the communications network to game user clients 250 executing in game user devices 260.

In one embodiment the architecture comprises a predefined content delivery center 50 that is communicatively coupled to other nodes in the system, e.g. servers or game user devices located at the remote location 10, the studio 20, the data integration center 30, the audio/video, and communicates with other nodes via the communications network 60. In one embodiment the predefined content delivery center receives a first request over the communications network 60 and provides predefined content in response to the first request.

In one embodiment the predefined content delivery center receives a first request over the communications network 60 from a game user device 260 and in response to the request sends predefined content via the communications network 60 to the requesting game user device 260.

In one embodiment the predefined content comprises computer program code portions configured to direct the game user device 260 to perform game user client 250 functionality.

In one embodiment the architecture comprises a communications network 60 that transfers information, such as data, from source nodes to destination nodes and where nodes in the system can simultaneously be source nodes and destination nodes. In one embodiment the network is a network of networks of private, public, academic, business, and government networks, of local to global scope, that are linked by a broad array of electronic, wireless and optical networking technologies. In one embodiment the network 60 is the internet.

In one embodiment the inventive concept is realized as a method comprising computer program code portions configured to direct a processor to perform the steps and functions of the system described herein.

In one embodiment the inventive concept is realized as a computer program product for enabling network based live casino gaming, the computer program product comprising: computer program code portions configured to direct a processor to perform the steps and functions of the system described herein.

An advantage with the invention is that the architecture supports live, real-time multi-game user, multi-gaming device gaming, multiple casino operators and multiple jurisdictions that is scalable with regards to the number of game users, the number of game devices, number of casino operators and the number of jurisdictions.

Game User Device

Figure 2:
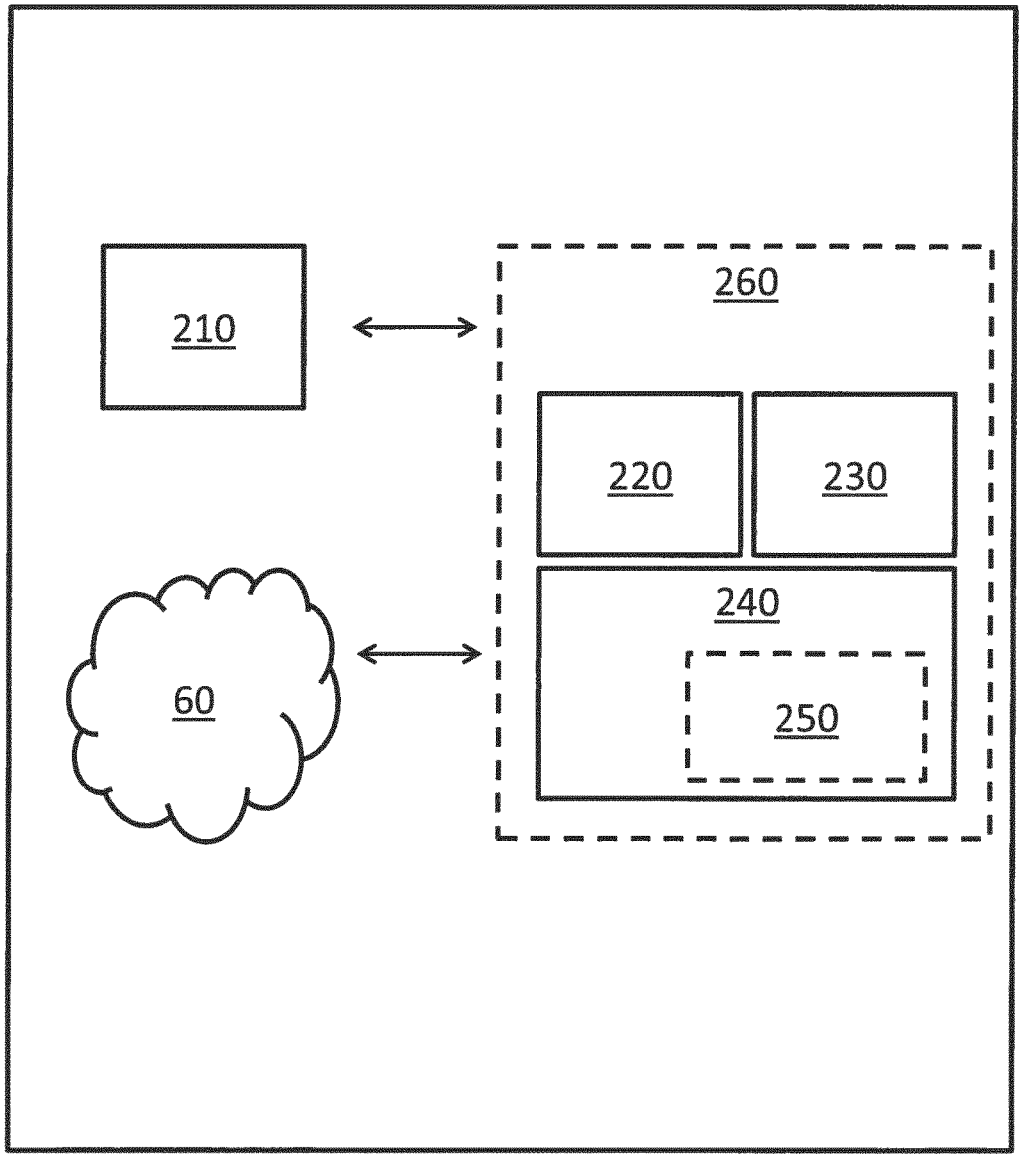
FIG. 2 describes an embodiment of a user device

FIG. 2. describes an embodiment of the invention where game users 210 at a remote location 10 are enabled to take part in network based live casino games by a game user device 260.

A general embodiment of a game user device 260 according to the inventive concept is realized as a system for enabling network based live casino gaming, wherein a game user 210 is enabled to participate from a remote location 10 in a live casino game operated by a casino operator 70. This system in one example comprises:

a display (220),
an input interface (230),
a processor (240), and
a game user client (250),
a non-volatile storage device (270)

wherein the display 220 is configured to present information pertaining to gaming activity, processed by the game user client (250), to the game user, wherein the input interface (230) is configured to receive input, associated to information pertaining to gaming activity, from the game user (210) and send the input to the game user client (250), wherein the non-volatile storage device (270) comprises computer program code portions configured to direct the processor to obtain predefined content, wherein the processor 240 executes predefined content required to perform game user client 250 functionality, wherein the game user client 250 functionality comprises any of:

processing input received from the input interface (230) into a first processed information and a second processed information, sending a first processed information to said display (220) and sending a second information to the multiplayer server (410) in the data center via said communications network (60), processing information pertaining to gaming activity received from the multiplayer server (410) and to send a first processed information to said display (220), and), and processing a casino operator specific audio/video data stream received from the audio/video streaming provider data center (40) and send to said display (220).

In another embodiment obtaining predefined content comprises sending a predetermined content request to the predefined content delivery center (50) and receives predefined content in response to the predetermined content request. In one embodiment processing information pertaining to gaming activity received from the multiplayer server (410) comprises executing game user live casino game logic based on the received information.

In one example input is received from the input interface 230, indicating that the user places a bet on an associated gaming device 311, the input is processed into a first information and presented on the display and the input is processed into a second information, e.g. a game user event indicating placing a bet, and sent to the multiplayer server 410. The multiplayer server 410 stores part of the second information relevant to the gaming devises status, forwards information related to game logic execution to the game server 420 and information related to winnings earnings or game user account to the financial server 430. In one embodiment the input received from the input interface indicates comprises one of:

the game user entering or leaving a game device
the game user placing bets
the game user sending messages to other game users
the game user entering game instructions.

Studio

Figure 3:
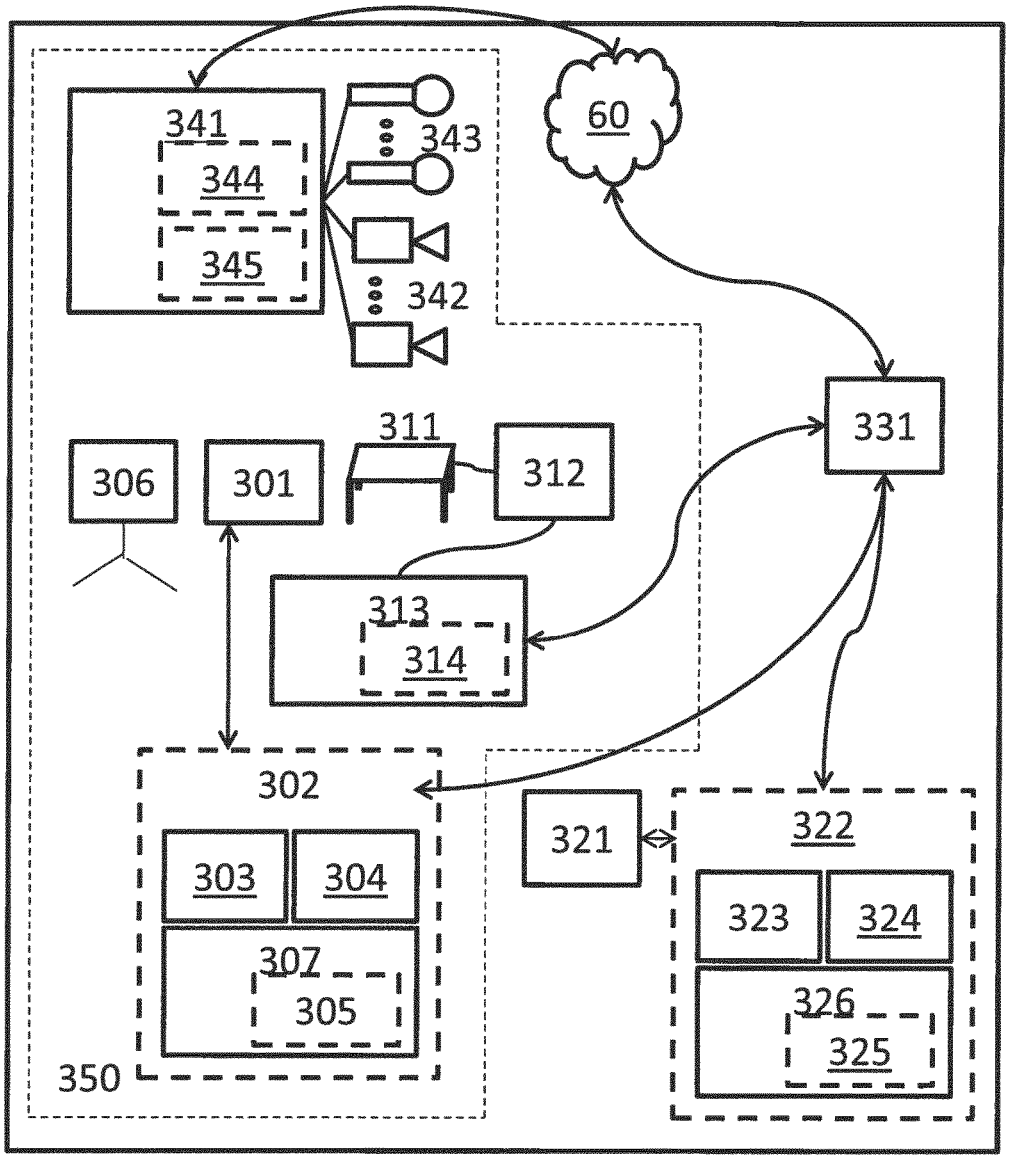
FIG. 3 describes an embodiment of a studio configured to support live casino gambling.

FIG. 3. describes an embodiment of the invention showing schematics of a studio 20.

A general embodiment of a studio 20 according to the inventive concept is realized as a system for enabling network based live casino gaming. This system in one example comprises:

one or a plurality of micro studios 350, wherein each micro studio comprises:
- a screen 306 configured to reflect light;
- a gaming device 311 comprising gaming sensors 312 configured to detect the live casino gaming activity performed on the casino gaming device 311, wherein the gaming sensors 312 is communicatively coupled to a gaming sensor processor 313,
- one or a plurality of video recording devices 342 and one or a plurality of microphones 343 recording audio/video in said micro studio communicatively coupled to an audio/video integration device 341, wherein one of the video recording devices 342 is arranged to capture video images of the casino gaming device 311 and of the screen 306;
- an audio/video integration device 341 configured to perform audio/video integration functionality, wherein the audio/video integration device 341 is configured to communicate integrated audio/video data to the audio/video data streaming provider data center 40 via said communications network 60, and;

a studio server 331 configured to communicate game related information pertaining to gaming activity occurring in the micro studio to the audio/video data streaming provider data center 40 and to the data integration center 30 via said communications network 60, wherein a studio server 331 is further configured to receive game related information pertaining to gaming activity from the multiplayer server 410 via said communications network 60.

In one embodiment the gaming device 311, is located in front of a screen 306.

Audio/Video Integration Functionality

In one embodiment the audio/video integration functionality comprises combining the video recorded by the cameras (242) and audio recorded by the microphones (343) into a combined audio and video stream In one embodiment the audio/video integration functionality comprises encoding the combined audio and video stream into an encoded combined audio and video stream using forward error correction (FEC)

In one embodiment the microphones 343 are any one of hand held microphones, personal microphones (also called lavaliere/clip-on microphones), shotgun microphones, boundary effect microphone (also called PZ or PZM), contact microphones, studio microphones or any other microphones known in the art.

Screen

It may be very difficult to setup a live casino studio for generating mixable content, e.g. by chroma keying techniques, when expecting near 24/7 operations. A live studio that utilizes mixable content techniques, such as chroma keying techniques, will require a very special lighting setup for a content mixing unit, such as a chroma keying processor, to be able to separate the foreground from the backing wall or screen. Traditional chroma keying uses a backing wall or cloth in a special green ("greenscreen") or blue ("bluescreen") color, where both the subject (foreground) and backing wall are brightly lit to produce an image that:

Has some sort of theatrical style lighting on the subject

Key light, fill light together with one or more back lights.

Has flood lighting to make the backing wall as evenly lit as possible.

Has compensating lights to remove shadows cast by the subject on the backing wall.

This setup require many studio lights of various types—Dimmed reflectors, redheads and light panes, and all those lights have to be very exact in position, direction, spread, intensity and color temperature.

Conventional systems suffers from various problems, such as:

Many expensive lights are required to solve the chroma keying.

Given near 24/7 operation of a live casino studio setup, using many lights will produce a lot of heat, increasing power consumption and making game leader ergonomics unbearable.

Conventional systems using greenscreen or bluescreen chroma keying also produces color spill on the subject, where the subject is reflecting green or blue colors from the background.

In conventional systems the subject and subject lighting is often moved away from the backing wall, increasing the requirements of studio size.

Each micro studio setup will have fixed locations of both the subject and camera, with little or no movement. This helps reduce the chroma keying problem.

Instead of using a green or blue colored background with specialized background lighting, a reflective background together with a colored light-emitting diode (LED) light located at the camera lens is used.

The reflective background may be gray to the human eye, but has tiny mirrors or glass beads woven into the fabric. The cloth will reflect any light hitting it directly back to the light source.

The LED light may consist of many blue or green LED lights mounted in a circular casing around the camera lens. The ring together with the cloth will work in conjunction so that light emitted from the ring is reflected directly back to the lens, producing a perfect green or blue colored background in the camera view.

The LED generates light in an exact and specific predetermined span of wavelengths that enables improved calibration of video recording devices, thereby an improved image quality may be achieved.

In one embodiment the video recording device 342 comprises a light emitting device, surrounding a video capturing sensor of the video recording device 342, configured to emit light with a wavelength within a first predetermined span onto the background screen 306, wherein the reflective surface is configured to reflect the emitted light from the light emitting device as light with a wavelength within a first predetermined span, and wherein the one or more video recording devices (342) are configured to capture incoming light reflected from the background screen (306).

In one embodiment the reflective surface comprises glass beads that act as reflectors.

In one embodiment the light emitting device comprises LED lights

In one embodiment, the video recording device 342 is configured to capture video of light reflected by the screen 306, wherein the capturing generates content with pixels having a pixel value within a second span.

In one example the video recording devices are calibrated to generate pixel values within a second span when recording emitted light with a wavelength within a first predetermined span, thereby a content may filter or separate pixels representing the screen or background from pixels representing other objects, such as the game leader and the game device. As the LED lights might emit light within a narrow span a good separation may be achieved and thereby an improved image quality may be achieved.

The inventive concept provides e.g. the following advantages:

The solution produces a very evenly lit and evenly colored background, without any extra lights besides the lens mounted LED light. Thus, the number of lights and amount of lighting is reduced, resulting in better ergonomics and less power consumption.

The colored background does not produce color spill on the subject, since the reflecting background reflects light straight back to the camera lens. Thus, the subject can be moved closer to the background, and the studio footprint is reduced.

Casino Gaming Device

In one embodiment the gaming sensor processor 313 comprises a gaming sensor client 314 performing gaming device client functionality.

In one embodiment the client functionality comprises detecting said live casino gaming activity performed on the casino gaming device 311 and sending information related to said detected live casino gaming activity to the studio server 331.

In one embodiment the gaming device 311 comprises a live gaming equipment (LGE) configured as a casino roulette table.

In one embodiment the gaming device 311 comprises a live gaming equipment (LGE) configured for one of the casino games Asian stud, Asia Poker, Australian Pontoon, Baccarat, Blackjack, Blackjack switch, Caribbean Stud Poker, Casino Hold'em, Casino war, Chinese poker, Fan-Tan, Faro, Four card poker, Let It Ride, Mambo stud, Pai gow poker, Poker, Pyramid Poker, Red Dog, Spanish 21, Super Fun 21, Teen Patti, Texas Hold'em, Texas Hold'em, Bonus Poker, Three card poker, Two-up, Penny-up, Ultimate Texas Hold'em.

Dynamic Switching of Video Streams

The video feeds, e.g. from a roulette table, are streamed live across the internet using streaming servers. Any live video streaming introduces latency, i.e. a delay between real world events and events taking place in the streamed video. In order to synchronize streamed video with gameplay events, so called cuepoints are injected into the video stream to enable the game client to match game play events to video events.

A live casino game player is given the opportunity to switch camera views between the croupier and a top view of the roulette wheel during gameplay, with the click of a button in the game client. Having multiple views of the same scene traditionally means publishing multiple video streams over the internet. This introduces problems when the player wishes to switch view. If the player game client is watching one stream at a time, there will be a substantial delay when the player chooses to switch view. This is due to the way handshaking is taking place between the client and the streaming server, and the way streaming video data is formatted. The client will experience this as a disconnect/reconnect sequence. If the player client would subscribe to the two streams at once, there would be no delay when switching camera views. The problem in this situation is that the number of streams being published as doubled, which in turn doubles the number of streaming servers, and the bandwidth requirements on the player client. There is also no way to guarantee that the two video streams are fully synchronized in respect to each other. The game client may be constructed so that the video is only visible in the top half of the game client user interface. By using a custom video mixer solution on location, the two views of the roulette wheel are scaled, positioned and composed into one larger video view. This larger video view, containing both camera views, is streamed to the clients. The scaling and positioning is known by the game client, which means that the client will show a subset of the large video view in the top half of the game client user interface. When the user chooses to change camera view, the video is positioned and scaled to show one of the two original views.

To enhance the gaming experience in live casino gaming various aspects of a live casino game might be presented with different field of view (FOV), different alignments of optical axes/camera angles or different rotational orientation of video recording devices. FOV refers to the extent of the observable world that is seen by a video recording device at any given moment. The camera angle marks the direction from specific location at which a video recording device is placed to capture an particular aspect of a live casino game. The rotational orientation refers to a rotation around the video recording device optical axis.

Switching between various aspects of a live casino game might be to change the aspect from a scene with a FOV including a game leader 301 and a gaming device 311 to an aspect including a scene with a FOV including just a gaming device. The camera angle might be changed from in front and above the game leader 301 and a gaming device 311 to a camera angle directly above the gaming device 311.

A non-limiting example of aspects might be an initial view of an aspect showing roulette game leader, a roulette gaming device and an animated part of the gaming device to an aspect showing a close-up of a roulette wheel as the ball falls into one of the pockets of the roulette wheel. Another example might be to switch from an aspect showing an entire black jack table to an aspect showing an individual players hand when new cards are received from the game leader.

The switch between various aspects might be triggered by user input or by game events detected by a gaming sensor processor 313.

In one non-limiting example this might involve a gaming sensor processor 313 detecting that a game event indicating a roulette ball has been released, indicating that no more bets may be placed, indicating that a roulette ball is about to come to a halt or a close-up on the game leader making an announcement.

In one embodiment the audio/video integration functionality comprises combining the video recorded by a plurality of cameras (242) and audio recorded by the microphones (243) in a micro studio into a combined audio and video stream associated with the gaming device 311 in the studio 20.

In one non-limiting example this might include combining the video an aspect from a scene with a FOV including a game leader 301 and a gaming device 311 and an aspect including a scene with a FOV including just a gaming device. In one embodiment the audio/video integration functionality further comprises taking a first part of a captured video image captured by a first video recording device (342) and second part of a captured video image captured by a second video recording device (342) and combining them as a single captured video image.

A non-limiting example wherein said first part comprises an aspect showing roulette game leader, a roulette gaming device and an animated part of the gaming device captured by a first video recording device (342) and a second part comprises an aspect showing a close-up of a roulette wheel as the ball falls into one of the pockets of the roulette wheel.

In one embodiment the first video recording device (342) and second video recording device (342) are configured to capture video in the same video format.

In one embodiment the audio/video integration functionality further comprises taking a first part of a captured video image captured by a first video recording device (342), a second part of a captured video image captured by a second video recording device (342), augmenting said first part or second part with a third video content and combining the augmented first part and the second part or the first part and the augmented second part as a single captured video image. In one embodiment the video format is configured to one of 720p, 1080i, 1080p, 2160p, 4320p, 8640p.

In one embodiment combining as a single captured video image comprises:

- obtaining a first part by cropping a first captured video in a way that the cropped video will fit in the top part of a video format
- obtaining a second part by cropping a second captured video in a way that the cropped video will fit in the lower part of a video format
- combining said first part and said second part as a single image into a predefined video format, e.g. by using half the available lines in a video format to represent the first cropped captured image and the other half to represent the second cropped captured image.

In one embodiment combining as a single captured video image comprises:

obtaining a first part by scaling a first captured video in a way that the scaled video will fit in the top part of a video format obtaining a second part by scaling a second captured video in a way that the scaled video will fit in the lower part of a video format combining said first part and said second part as a single image into a predefined video format, e.g. by using half the available lines in a video format to represent the first scaled captured image and the other half to represent the second scaled captured image.

In one example, a first video recording device 342 is configured to capture images of the gaming device 311, the screen 306 and the game leader 301. A second video recording device 342 is configured to capture a top view image of the gaming device. At least a first microphone 343 is configured to obtain a directed sound from the game leader and a second microphone is configured to obtain sound from the gaming device 311. The second microphone is integrated in the gaming device to minimize interfering background noise from surrounding micro studios. The first captured video is cropped in a way that the cropped video will fit in the top part of a video format and the second captured video is cropped in a way that the cropped video will fit in the lower part of a video format and the two captured and cropped video images are combined as a single image into a predefined video format, e.g. by using half the available lines in a video format to represent the first cropped captured image and the other half to represent the second cropped captured image. The combined video is integrated with the sound recorded by the microphones 343 and sent as an integrated audio/video stream to the audio/video data streaming provider data center 40 via the communications network 60.

In a further example, any number of video recording devices 342 are configured to capture various visual aspects of a micro studio and the cropping is performed so that each video recording device 342 gets a part of the video format. E.g. fitting 2, 4, 6, 8, 16 etc. captured and cropped images into a video format.

In one embodiment wherein the first part and the second part are disjunctive.

In one non-limiting example wherein said first part is combined so that it occupies the top part of the combined image and the second part occupies the lower part of the combined image, wherein the top part and the lower part are disjunctive.

The inventive concept provides e.g. the following advantages:

The solution introduces no delay when switching camera view, since both camera views are embedded into the larger video view.

The streaming server requirements are lowered from sending the camera view streams separately.

All cuepoints that are added to the larger video view stream, will automatically affect both camera views.

Monitoring Erroneous Gaming Activity

When combining online gambling with live casino, the live gaming equipment needs to be integrated into the gaming system to provide an unbiased and accurate gaming result to the game users. It's important to streamline this process to make it as quick as it is accurate; all to provide the players with a good player experience. In conventional systems, e.g. a Roulette game round, comprises a number of game states represented by game events throughout a 'game round'. The state where this problem arises is for example when the winning ball falls down in the pocket of the Roulette wheel and then is presented to the player in the gaming client. The gaming device, with it's built in sensors, picks up the winning result and via a gaming sensor processor 313 communicates this to the rest of the gambling system, such as the data integration center. Before the system accepts the result, a manual check from the game leader in the studio is required. The conventional solution for this is making the dealer responsible to perform a "check & acknowledge" after each winning result is read. What this means is that they after each time the ball lands, they need to perform a "the result was correct"-process before any winning bets are paid out.

This behavior becomes very repetitive and, as only the game leader would be involved, might lead to erroneous results not being detected.

The inventive concept improves the "check & acknowledge" procedure by introducing monitoring by the gaming device, the pit boss and the game leader, whereby an alert procedure is introduced.

Gaming devices, e.g. live gaming equipment (LGE), today is considered extremely trustworthy and errors are extremely rare. Instead of do a manual 'OK' during every round; an "ALERT"-procedure is generated whenever something is out of the ordinary for the live gaming readers. Manual override is then also overseen by several key persons in the personnel, performed in real-time, within the live studio environment and not only limited to the responsible game leader but also the pit boss and the game client. All supervising personnel will have access to this "alert tool", which can stop/pause the game round. Regardless of who stops the game when an erroneous game round is played, the responsible person (Pit boss) gets alerted and needs to act on the error. Thereby reduce error probability when monitoring game play in a network based live casino is achieved.

In one embodiment the studio (20) further comprises:

a game leader device (302), a pit boss device (322), wherein the game leader device (302) comprises an input interface (304), wherein the pit boss device (322) comprises an input interface (324), wherein a particular activation of the game leader device's input interface (304) causes a first alert signal to be sent to a studio server (331), wherein particular activation of the pit boss device's input interface (3324) causes a second alert signal to be sent to a studio server (331), wherein the studio server (331) is configured to receive a first or a second alert signal, set the status of a gaming device (311) according to the alert signal, to send a third alert signal to the multiplayer server (410) and to send a fourth alert signal to a gaming sensor processor 313, wherein the multiplayer server (410) is configured to receive a third alert signal, send a fifth alert signal to the game user device (260) and send a sixth alert signal to the game leader device 302.

In one embodiment the first alert signal is a stop signal.

In one embodiment the second alert signal is one of: a stop signal, a cancel signal and a resume signal.

In one embodiment the third alert signal is one of: a stop signal, a cancel signal and a resume signal.

In one embodiment the fourth alert signal is one of: a stop signal, a resume signal and a reset signal.

In one embodiment the fifth alert signal is one of: a paused signal, a resumed signal and a cancel signal.

In one embodiment the fifth alert signal is one of: a paused signal, a resumed signal and a cancel signal.

The system of claim 1, wherein the gaming device 311 is configured to send a seventh alert signal to the studio server 331 when an erroneous condition is detected, e.g. that a foreign object is blocking the operation of the gaming device 311.

Game Leader

The casino game device is operated by a game leader 301 that performs casino game device actions on the casino game gaming device. The game leader 301 receives information and provides input through the use of a game leader device communicatively coupled to the studio server 331. The game leader device 302 comprises a display 303, input interface 304, a computing unit 307, such as a processor, and a game user client 305. The display 302 presents information processed by the game leader client 305 to the game leader 301. The input interface 304 receives input from the game leader and presents the input to the game leader client 305 that processes the input. The computing unit 307 executes instructions required to perform game leader client 305 functionality.

Examples of game leader client 305 functionality is to receive a first information from other nodes in the system, processing the first information to a second information and performing any of the steps of:

executing game leader logic based on the second information presenting the second information to the game leader by the use of the display 303

The game leader receives information on the display 303 and informs players 21 verbally (through recorded live audio and video) and in addition performs live gaming device actions accordingly. Another example of game leader client 305 functionality is to receive game leader 301 input via the input interface 304, processing the received game leader 301 input to a third information and performing any of the steps of:

executing game leader logic based on the third information presenting the third information to the game leader by the use of the display 303 sending the third information to other nodes in the system via the communications network 60, further detailed in FIGS. 1-7, such as servers or game user devices.

In one embodiment the first information is received from the studio server 331.

In one embodiment the first information is received from the multiplayer server 410

In one embodiment the third information is sent to the studio server 331.

In one embodiment the third information is sent to the multiplayer server 410.

Game Leader Input Interface

In one embodiment, when the game leader 301 detects an erroneous game action, e.g. a game action not detected or wrongfully detected by the sensors, the game leader will make a manual input using the input interface 304 that is processed by the game leader client which sends information, such as an event, to the studio server 331. If a severe problem is detected and inputted a stop event, effectively pausing game play until the issue has been resolved, is sent to the studio server 331. The game leader device 302 is communicatively coupled to a studio server 331 and the game leader client 314 communicates with the studio server 231 and the data integration center 30 via the communication network 60.

In one embodiment the input interface (204) comprises a button, which when pushed causes the game leader client (205) to send a stop event to the studio server (231), effectively pausing game play.

In one embodiment the button is visually diverting from the other parts of the input interface 304, e.g. brightly colored, physically protruding from the input interface or shaped in a shape diverting from the general input interface design. This makes the button easily identifiable and reduces activation delay by the game leader.

In one embodiment the recording functionality comprises combining the video recorded by the cameras (242) and audio recorded by the microphones (243) into a combined audio and video stream Pit Boss In one embodiment a person responsible for surveillance of a plurality of devices, from here on called pit boss 321, is capable of monitoring the casino games, configure the casino games and pausing the games and receives information and provides input through the use of a device 322. The device 322 comprises a display 323, input interface 324, a computing unit 326 and a pit boss client 325. The display 323 presents information processed by the pit boss client 325 to the pit boss. The input interface 324 receives input from the pit boss 221 and presents the input to the pit boss client 205 that processes the information to a third information. The computing unit 326 executes instructions required to perform pit boss client 325 functionality Examples of pit boss client 325 functionality is to receive a first information from other nodes in the system, processing the first information to a second information and performing one or both of:

executing pit boss logic based on the second information presenting the second information to the pit boss by the use of the display 323

The pit boss receives information on the display 303 and performs pit boss activity actions accordingly. Another example of pit boss client 325 functionality is to receive pit boss 321 input via the input interface 324, processing the received pit boss 321 input to a third information and performing any of the steps of:

executing pit boss logic based on the third information presenting the third information to the pit boss by the use of the display 323 sending the third information to other nodes in the system via the communications network 60, further detailed in FIGS. 1-7, such as servers or game user devices.

In one embodiment pit boss activity comprises any of:

configure and monitor game play.

setting up a studio gaming device 311 for game play opening and closing a studio gaming device 311 sending messages to players 21, etc.

In one embodiment the first information is received from the studio server 331.

In one embodiment the first information is received from the multiplayer server 410

In one embodiment the first information is received from the studio server 331 and received from the multiplayer server 410

In one embodiment the third information is sent to the studio server 331.

In one embodiment the third information is sent to the multiplayer server 410.

In one embodiment the third information is sent to the studio server 331 and is sent to the multiplayer server 410.

Pit Boss Input Interface

In one embodiment the pit boss 301 detects an erroneous game action, e.g. a game action not detected or wrongfully detected by the sensors, the pit boss will make a manual input using the input interface 304 that is processed by the pit boss client which sends information, such as an event, to the studio server 331. If a severe problem is detected and inputted a stop event, effectively pausing game play until the issue has been resolved, is sent to the studio server 331. The pit boss device 322 is communicatively coupled to a studio server 331 and the pit boss client 314 communicates with the studio server 231 and the data integration center 30 via the communication network 60.

In one embodiment the input interface 324 comprises at least a button, which when pushed causes the pit boss client 325 to send a stop event to the studio server 331, effectively pausing game play.

In one embodiment the button is visually diverting from the other parts of the input interface 304, e.g. brightly colored, physically protruding from the input interface or shaped in a shape diverting from the general input interface design. This makes the button easily identifiable and reduces activation delay by the pit boss.

Studio Server

In one example the studio server 331 is to receive gaming sensor information, e.g. events, from gaming sensors 312, package and forward events to the multiplayer server 410 as well as send synchronization information, called cuepoints, to the audio/video data streaming provider center 40 to ensure that the published live video stream is synchronized with game play in the game user client 250 executing in the game user device 260. The studio server is clustered to provide failover capabilities. In practice, all instances of the studio server cluster will receive sensor output but only the current master node will send events to the multiplayer platform and synchronization information to the audio/video data streaming provider. The studio server 331 communicates with the game leader device and the pit boss device gaming sensor processor 313 341 to exchange information related to game play. The studio server is communicatively coupled via the communications network 60 and communicates with the audio/video data streaming provider data center 40 and the data integration center 30.

Data Integration Center

Figure 4:
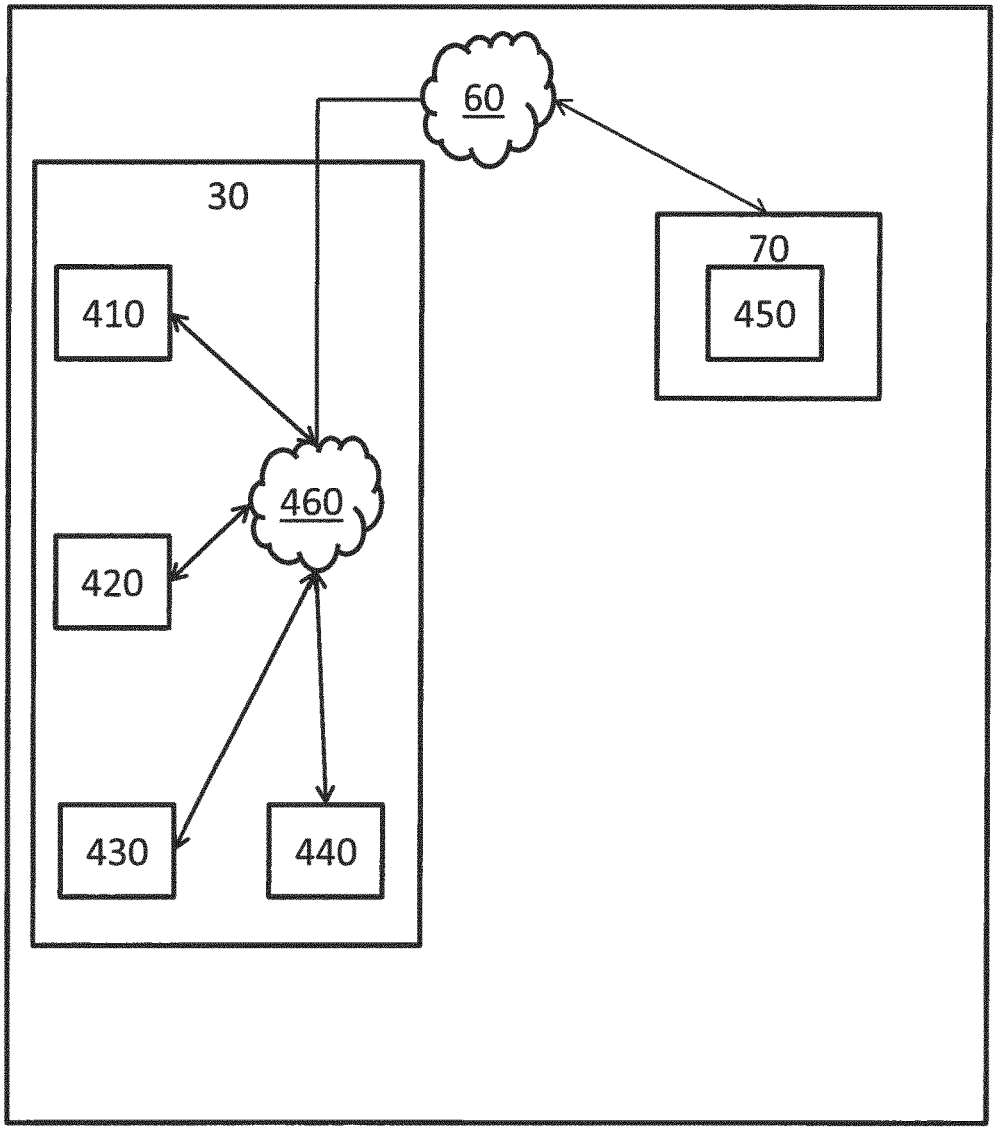
FIG. 4 describes an embodiment of a data integration center configured to support live casino gambling.

FIG. 4. describes an embodiment of the invention showing a schematics of a data integration center comprising a multiplayer server 410 a financial server 430, a game server 420, a statistics server 440 and an internal communications network 460.

A general embodiment of a data integration center 30 according to the inventive concept is realized as a system for enabling network based live casino gaming. This system in one example comprises:

a multiplayer server 410, a game server (420), a financial server (430)

and a statistics server (440) being communicatively coupled in an internal communications network 460 that is communicatively coupled to the communications network (60); and wherein the multiplayer server (410) is configured to manage a plurality of game user clients (250) executed in respective game user devices (260) dependent on game related information pertaining to gaming activity received from a studio server (331) comprised in said studio (20);

wherein the multiplayer server (410) is further configured to manage game related information pertaining to status of game devices 311 and to store the game related information pertaining to status of game devices 311 in a non-volatile storage device, wherein the multiplayer server (410) is further configured to communicate game related information pertaining to gaming activity with the game server (420) where central game logic is executed, wherein the multiplayer server (410) is further configured to trigger game user account transactions by communicating with the financial server 430, wherein the multiplayer server (410) is further configured to accomplish game round reporting by communicating with the statistics server (440), wherein the multiplayer server (410) is configured to receive game related information pertaining to gaming activity from the game user device (260), wherein the multiplayer server (410) is configured to send game related information pertaining to gaming activity to all managed game user devices (260);

wherein the game server 420 is configured to execute game logic and thereby determining the result of gaming based on game related information pertaining to gaming activity, which conforms to jurisdictions requirements of the game servers 420 geographical location, wherein the financial server is configured to perform game user account transactions and transactions pertaining to winnings/earnings to and from the casino operators (70), a casino operator communications interface (470) configured to enable communication with a casino operator server (70) configured for serving a game user device (with information pertaining to a game user (210);

In one embodiment the multiplayer server 410 is configured to maintain the status of gaming devices 311 located in the studio 20.

Predefined Content Delivery Center

Figure 5:
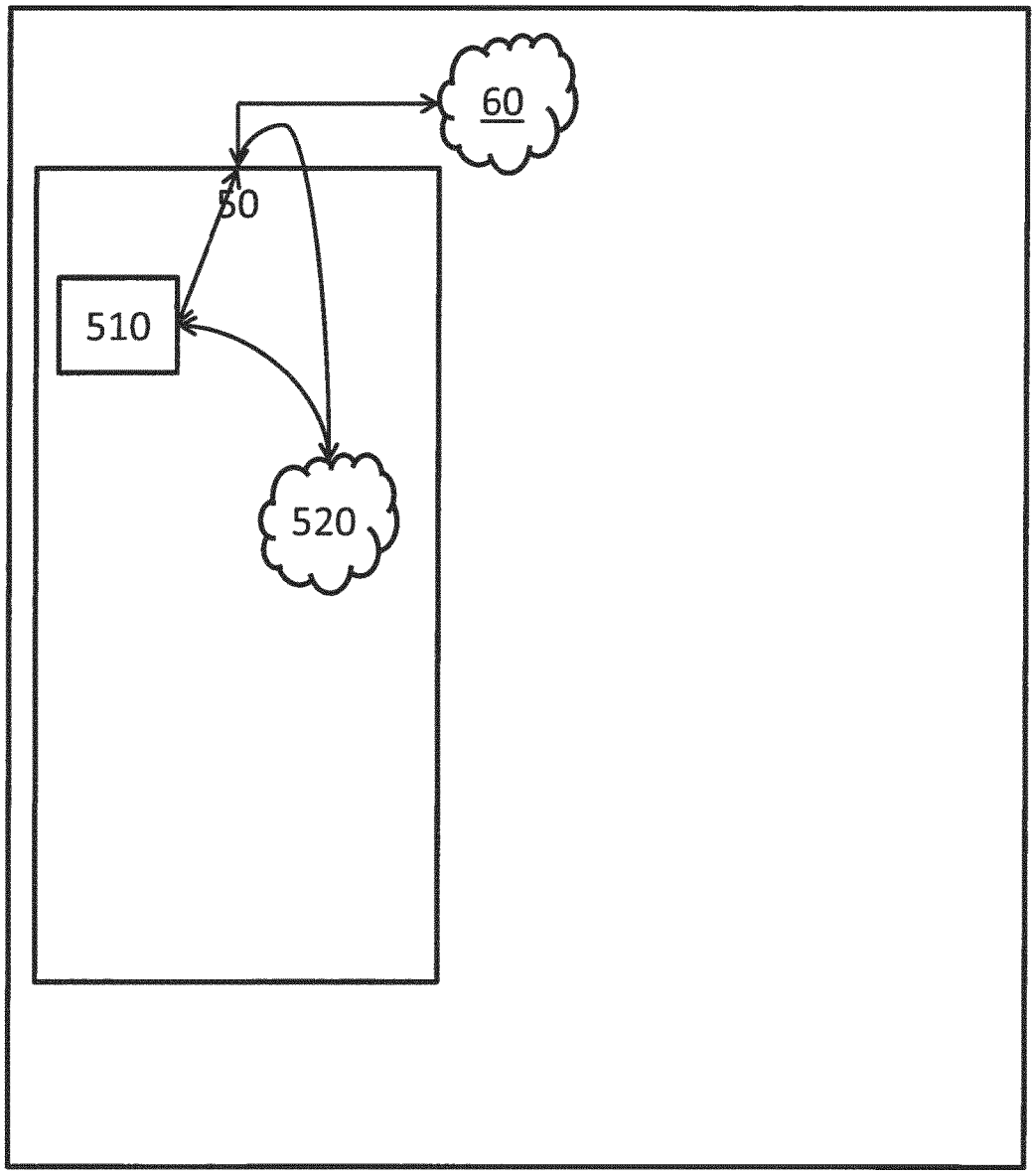
FIG. 5 describes an embodiment of a predefined content delivery center configured to support live casino gambling.

FIG. 5. describes an embodiment of the invention comprising a network architecture for enabling playing of network based live casino games.

A general embodiment of a predefined content delivery center 50 according to the inventive concept is realized as a system for enabling network based live casino gaming. This system in one example comprises:

a predefined content delivery server 510 configured to receive a request from a game user device 260 via the communications network 60 and further configured to send predefined content via the communications network 60 in response to the request from the game user device 260.

In one embodiment the communications network 60 that transfers information, such as data, from source nodes to destination nodes and where nodes in the system can simultaneously be source nodes and destination nodes.

Audio/Video Data Streaming Provider Data Center

Figure 6:
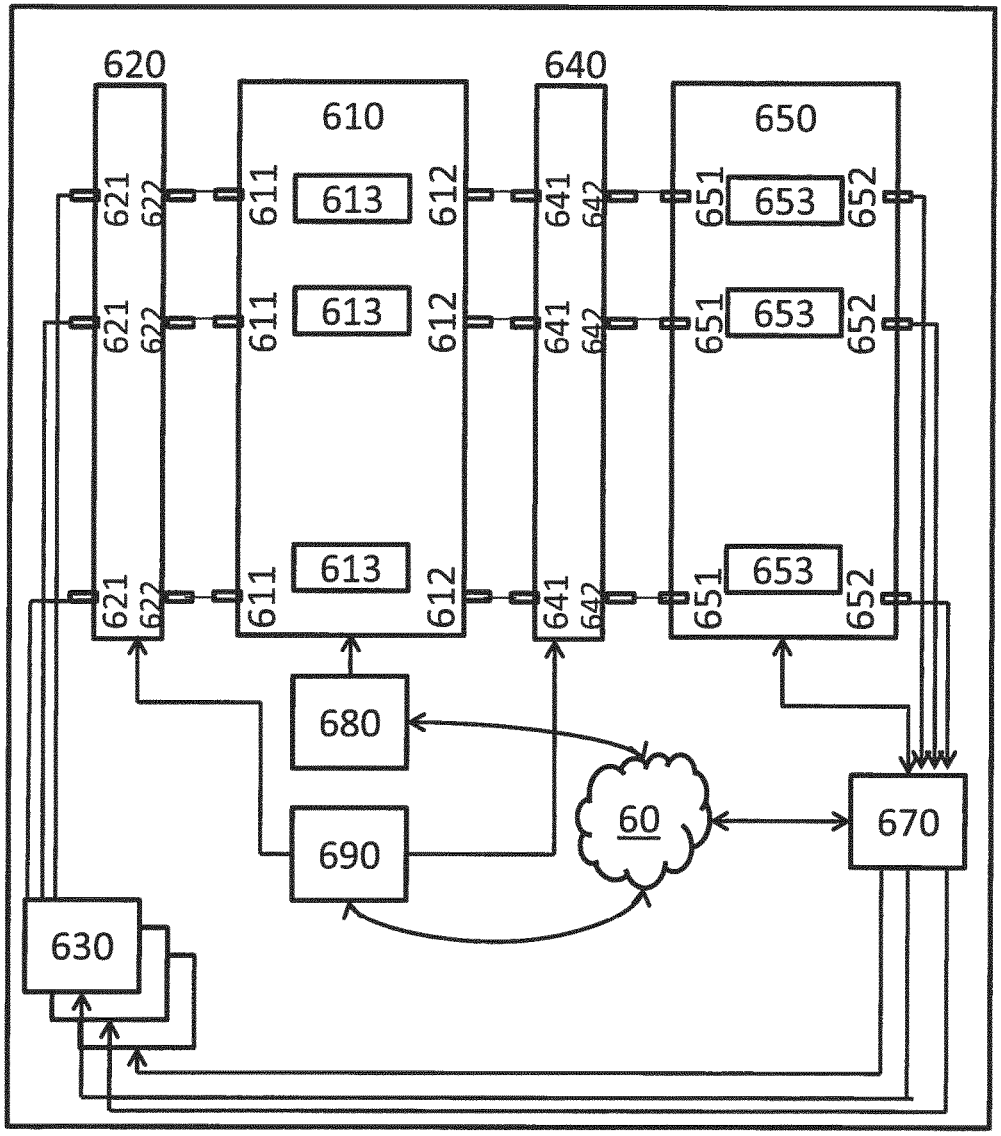
FIG. 6 describes an embodiment of an audio/video streaming provider data center (40) configured to support live casino gambling.

FIG. 6. describes an embodiment of the invention comprising a network architecture for enabling playing of network based live casino games.

In network based live casinos, the challenge is to maximize on the commercial benefits of broadcasting live streaming of Live Casino content from a location in spite of its high bandwidth costs. It is desirable is to reduce the bandwidth as much as possible and to maximize the number of users per physical gaming device; thus reducing the cost of both bandwidth and labour cost per active user.

The studio related first content, e.g. an aspect depicting a game leader and a gaming device, is recorded in the studio, streamed to the audio/video data streaming provider data center and used to generate multiple casino operator specific and game user specific audio/video data streams. I.e. the bandwidth requirements for transferring the first content from the studio is reduced compared to conventional systems where casino operator specific and game user specific audio/video data streams would be generated in the studio.

In an non-limiting example the studio may therefore be located in a geographical location where available bandwidth is limited and costly and the expansion to casino operator specific and game user specific audio/video data streams in the audio/video data streaming provider data center may be performed in a geographical location where data bandwidth is freely available at a significantly lower cost.

For each physical gaming device, a screen is used to record gaming activity in the studio in order to later dynamically change the background depending on the association between a user and a game operator. The monochrome background is replaced with either a static or moving background with the help of Chroma-Key technology.

By splitting the stream into one separate stream per customer, each customer can receive an individual background and thus increasing the commercial value of the service without affecting the number of game leaders and game devices, thereby reducing the cost of labour and equipment. The number of game users and associated game operators receiving a video stream from a single gaming device is therefore scalable and mainly limited by live casino game rules.

In one non-limiting example a particular live casino game, such as roulette, may allow N players or game users at each table. As the number of game user specific audio/video data streams is scalable, N game users for each game operator may be derived or generated for each physical gaming device and game leader. As long as no limitation of the capacity of the system is exceeded with regards to available bandwidth and processing capacity an nearly unlimited amount of game user specific audio/video data streams may be generated by the audio/video data streaming provider data center from a single first content, e.g. an aspect depicting a game leader and a gaming device.

Using one stream per game table per customer significantly increases the amount of used bandwidth. Even though other commercial factors motivate the location of the broadcasting studio, the bandwidth cost may still be high in comparison to other locations in the world.

By moving the Chroma-key step in the contribution chain to an alternate location bandwidth usage is minimized at the location of the broadcasting studio. The stream quality is kept high by using RTP Forward Error Correction (FEC).

A general embodiment of an audio/video data streaming provider data center (40) according to the inventive concept is realized as a system for enabling network based live casino gaming, wherein a game user (210) is enabled to participate from a remote location (10) in a live casino game operated by a casino operator (70). This system in one example comprises:

an audio/video data streaming provider server (670),
a decoder (630),
a first connection unit (620),
a content mixing unit (610),
a content generator (680),
a second connection unit (640), and
an encoder unit (650), wherein the content generator (680) and the streaming provider server (670) are communicatively coupled to the communications network (60);

wherein the audio/video data streaming provider server (670) is configured to receive multiple streams of integrated audio/video data as multiple streams of a first content from an audio/video integration device (341) in the studio 20, receive game related information from a studio server 331, receive game related information pertaining to gaming activity, from a studio server 331 in a studio (20) and to send the first content to a plurality of decoders (630);

wherein the decoders (630) receives the multiple streams of a first content from the audio/video data streaming provider server (670), decodes the first content into multiple streams of a decoded first content using forward error correction (FEC) and sends the multiple streams of decoded first content to a content mixing unit (610);

wherein the content mixing unit (610) is configured to obtain a plurality of streams of casino operator specific content from a content generator (680);

wherein the content mixing unit (610) is further configured to generate a plurality of mixed streams by mixing multiple streams of the first content with multiple streams of casino operator specific content, to inject game related information as cuepoints into the mixed streams to enable game user clients (250) to synchronize the mixed streams to game related information pertaining to gaming activity and to send the plurality of mixed streams to the audio/video data streaming provider server (670);

wherein the audio/video data streaming provider server (670) is further configured to send the mixed streams via the communications network (60) to the game user clients (250)

In one embodiment the first connection unit 620 and the second connection unit 640 is configured to perform coupling from an arbitrary input port 621 and 651 to an arbitrary output port 622 and 652.

In one embodiment coupling is configured using any of optical, electrical, magnetical wireless technology.

In one embodiment coupling is performed using coaxial cables.

In one embodiment coupling is performed using network patch cables.

In one embodiment coupling is performed using a router, network switch or any other node known to a person skilled in the art for performing coupling.

When using multiple game tables in combination with separate video streams per customer, the cost of currently unused hardware cost is significant. There is a need to be able to handle separate streams with branded backgrounds for all customers for an individual table, but there is only a limited number of actual available slots on a table. In addition, each individual stream would be susceptible to the risk of having a number of single points of failures in the video stream contribution chain. As an example, consider offering the Live Casino service to 100 customers. Consider an individual game table with 7 available concurrent slots. Having dedicated hardware available to serve individually branded streams for each customer would require 100 sets of chroma-keyer even though only 7 could be used at any given time.

In one embodiment the audio/video data streaming provider data center 40 further comprises a connection control unit 690, wherein the connection control unit 690 is communicatively coupled to the a first connection unit 620, the a second connection unit 620 and the communications network 60, wherein the connection control unit 690 is configured to control the first connection unit 620 to connect an arbitrary input port 621 to an arbitrary output port 622, to control the second connection unit 640 to connect an arbitrary input port 651 to an arbitrary output port 652 based on control signals received from any of the multiplayer server 410, the financial server 430, the game server 420 and the statistics server 440 via communications network 60.

In one embodiment the first content comprises of a predetermined number of pixels and the second content comprises of the same number of predetermined pixels. The pixels of the first content and the second content each comprises a pixel value generated by the video recording devices 342 representative of a wavelength of light. The mixing comprises replacing pixels in the first content with pixels of the second content if the pixel value of the first content is within a first span of pixel values.

In one embodiment the second content might be predefined and stored in the content generator or received live by the content generator from an internal source or an external source.

In one example the second content is received by the content generator 680 from the casino operator 70.

In one embodiment the second video content is unique to each network casino operator.

In one embodiment second content may be static or dynamic.

Switching to Animated Game Devices

When a game user is involved in playing a live casino game it might be desirable to enable simultaneous gaming on other auxiliary network based casino games, such as video slots or video slot machines.

Such other network based casino games may be provided as part of the casino operator specific content, e.g. presented in the background of the first content received from an audio/video integration device (341) in the studio.

The selection of a virtual representation of a second set of gaming devices, such as video slot machines or video slots, might be selected by a game user or selected based on the game users' characteristics, such as age, sex and history of previous play on network based casino games.

The game user may add, remove, start, stop or monitor game play on the network based casino games by providing user indications.

In one embodiment, a audio/video data streaming provider data center (40), wherein the multiple streams of a first content received from an audio/video integration device (341) in the studio (20) are associated to a first set of gaming devices (311) in the studio (20) and wherein the plurality of casino operator specific content obtained from the content generator (680) comprises visual representations of a second set of gaming devices In one embodiment the second set of gaming devices are animated slot machines.

In one embodiment the invention is realized as a method for enabling network based live casino gaming, wherein a game user (210) is enabled to participate from a remote location (10) in a live casino game operated by a casino operator (70), the method comprising computer program code portions configured to direct a processor to perform the steps and functions of the preceding embodiments.

In one embodiment the invention is realized as a program product for enabling network based live casino gaming, wherein a game user (210) is enabled to participate from a remote location (10) in a live casino game operated by a casino operator (70), the computer program product comprising: computer program code portions configured to direct a processor to perform the steps and functions of the preceding embodiments.

In example a user makes user indication, such as a mouse over user indication, on a animated slot machine and the game user client is configured to display a description of the game on said animated slot machine, thereby allowing simultaneous play of a a live casino game and multiple auxiliary network based casino games.

In one example, winning amounts from a game that is played displayed over said animated slot machine.

In one example said game user client is configured to maximize the game when interaction is required by the player, e.g. when entering a bonus game.

In one example said game user client is configured to display the spin of the wheel of said animated slot machine, when a user performs a mouse over user indication.

In one example when entering a game on a gaming device you will see the game leader, the gaming device and a number of animated gaming devices in the background, e.g. slot machines. The slot machines in the background can be selected through the game user input interface 230 and thereby the players load and display the game associated with the animated gaming device. In one example the gaming devices in the background are selected from a set of possible animated gaming devices based on a game user profile. In one example the game user profile is based upon his player characteristics, age, sex and history of play.

In one example an animated gaming device can be configured to perform auto play. In one auto play involves a processor running the game, entering bets and instructions.

In one example a slot machine indicates in the background winnings by flashing the winning amount.

In one example when the game requires interaction from the player, e.g. a bonus game is entered while the game is in background, the game window is automatically maximized. The game can then run in minimized and automatic mode.

Dynamic Allocation of Streaming Equipment

To further explain the problem of providing more efficient use of equipment to support multiple casino operators associated to a gaming device an example is given: Consider offering network based live casino to 100 game users. Consider an individual gaming device with seven available slots for game users. Having dedicated hardware available to serve individually casino operator branded streams for each customer would require 100 sets of content mixing processors 613 even though only seven could be used at any given time.

In one example an game user, associated to a certain casino operator starts a network based live casino game, the following steps may be taken:

1. The game user logs in to the game.
2. The game server identifies what casino operator the end user is associated to and assigns the end user to an available game device slot.
3. The game server sends a request for a stream to the connection control unit 690, giving information about the identified brand and the assigned gaming device slot.
4. The connection control unit configures an audio/video data streaming provider server to connect the recorded video of the assigned table with an available decoder 630.
5. The audio/video data streaming provider server configures a decoder to accept the stream from the selected decoder.
6. The audio/video data streaming provider server configures a first connection unit 620 to connect the selected decoder output to the input of an available content mixing processor 613.
7. The audio/video data streaming provider server configures the selected content mixing processor 613 to insert the background content of the identified brand associated with the game user.

8. The audio/video data streaming provider server configures a second connection unit to connect the output of the selected content mixing processor 613 to the input of an available encoder 653.

9. The audio/video data streaming provider server configures the selected encoder 653 to start broadcasting the content to the communications network 60 via the audio/video data streaming provider server.

10. The audio/video data streaming provider server sends information to the game server, such as URL:s, about the streamed content now being broadcasted to the Internet.

If the audio/video data streaming provider server identifies that the identified brand is already active on the selected game table, steps 4 through 9 are skipped and the stream switching device immediately returns with information about the streamed content now being broadcasted to the communications network.

In one embodiment the audio/video data streaming provider data center 40 further comprises a connection control unit (690), wherein the connection control unit (690) is communicatively coupled to the a first connection unit 620, a second connection unit (620) and the communications network (60), wherein the connection control unit (690) is configured to control the first connection unit (620) to connect an arbitrary input port (621) to an arbitrary output port (622), to control the second connection unit (640) to connect an arbitrary input port 651 to an arbitrary output port 652 based on control signals received from any of the multiplayer server 410, the financial server 430, the game server 420 and the statistics server 440 via communications network 60.

In one embodiment the received control signal comprises information indicating that a gaming device (311) is associated to a casino operator (70).

In one embodiment the received control signal further comprises information indicating that a game user client executing on a game user device (260) is associated to a casino operator (70).

In one embodiment the inventive concept is realized as a method for enabling network based live casino gaming, wherein a game user (210) is enabled to participate from a remote location (10) in a live casino game operated by a casino operator (70), the method comprising computer program code portions configured to direct a processor to perform the steps and functions of the preceding system.

In one embodiment the inventive concept is realized as a computer program product for enabling network based live casino gaming, wherein a game user (210) is enabled to participate from a remote location (10) in a live casino game operated by a casino operator (70), the computer program product comprising: computer program code portions configured to direct a processor to perform the steps and functions of the preceding system.

Monitoring Game Play

Figure 7:
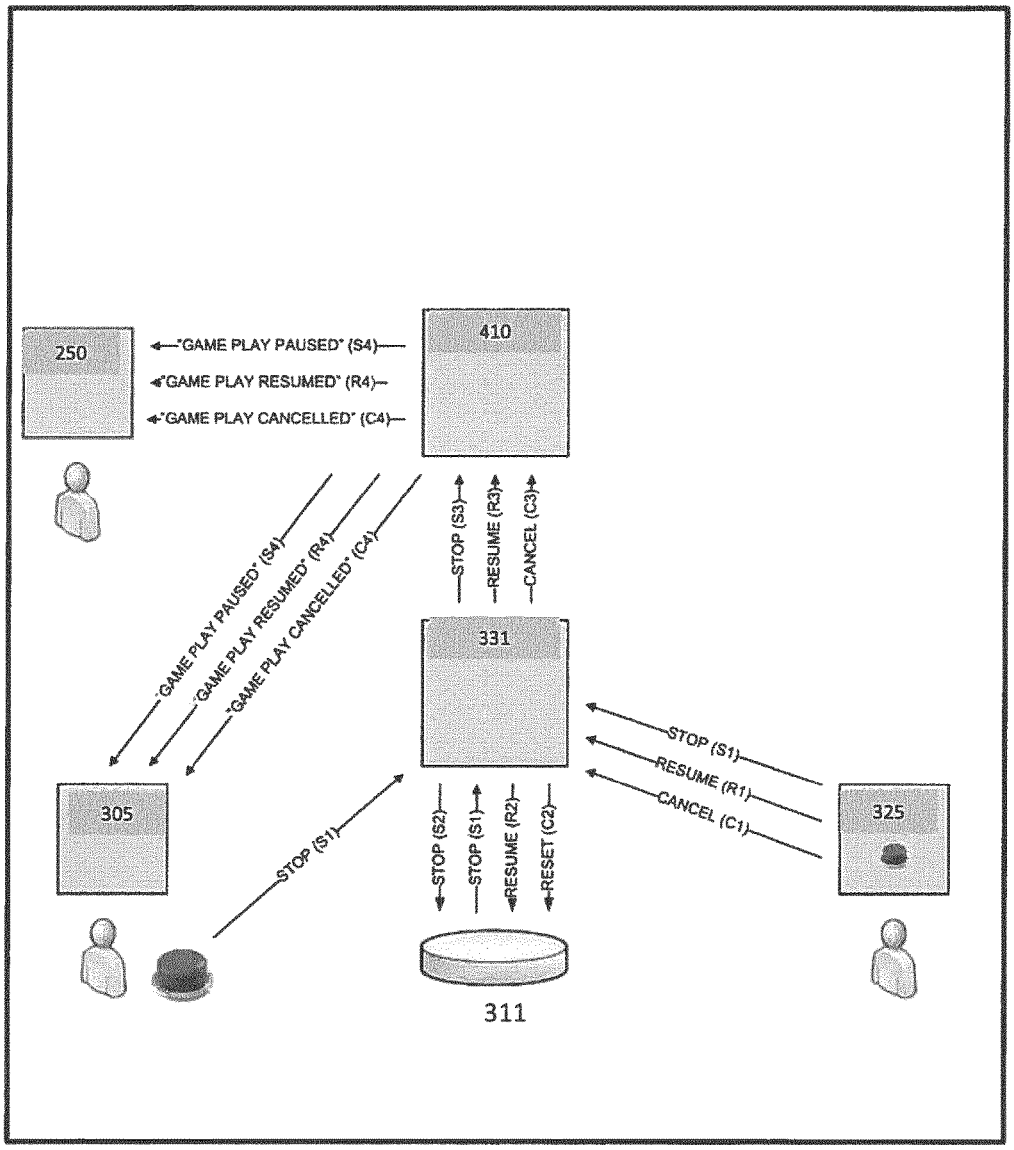
FIG. 7 describes an embodiment of a method for reduce error probability when monitoring game play in a network based live casino

FIG. 7. describes an embodiment of the invention realized as a method for reduce error probability when monitoring game play in a network based live casino.

A gaming device for network based live casino gaming relies on built-in sensors in the gaming device that via a gaming sensor processor sends the results as information to a studio server. The information pertaining to gaming activity needs to be manually verified to give a trustworthy and good game user experience. By improving this process through reporting when discrepancies occur between the physical game play result and the result recorded by the control logic, instead of reporting that no discrepancy has occurred as in prior art solutions, the number of entries are reduced by the game leader which shortens the game round time and also reduces potential game leader entry errors.

In one embodiment a studio (20) further comprises:

a game leader device (302), a pit boss device (322), wherein the game leader device (302) comprises an input interface (304), wherein the pit boss device (322) comprises an input interface (324), wherein a particular activation of the game leader device's input interface (304) causes a first alert signal to be sent to a studio server (331), wherein particular activation of the pit boss device's input interface (3324) causes a second alert signal to be sent to a studio server (331), wherein the studio server (331) is configured to receive a first or a second alert signal, set the status of a gaming device (311) according to the alert signal, to send a third alert signal to the multiplayer server (410) and to send a fourth alert signal to a gaming sensor processor 313, wherein the multiplayer server (410) is configured to receive a third alert signal, send a fifth alert signal to the game user device (260) and send a sixth alert signal to the game leader device 302.

In an embodiment of the invention realized as a method for reduce error probability when monitoring game play in a network based live casino, wherein the method comprises:

activation of the game leader device's input interface (304) that causes a first alert signal to be sent or activation of the pit boss device's input interface (324) causes a second alert signal to be sent to a studio server (331);

a first or a second alert signal is received the status of a gaming device (311) is set according to the received first or second alert signal, a third alert signal is sent and to send a fourth alert signal, receiving a third alert signal;

sending a fifth alert signal and send a sixth alert signal

In one embodiment the first alert signal is a stop signal.

In one embodiment the second alert signal is one of:

a stop signal, a cancel signal and a resume signal.

In one embodiment the third alert signal is one of:

a stop signal, a cancel signal and a resume signal.

In one embodiment the fourth alert signal is one of:

a stop signal, a resume signal and a reset signal.

In one embodiment the fifth alert signal is one of:

a paused signal, a resumed signal and a cancel signal.

In one embodiment the fifth alert signal is one of:

a paused signal, a resumed signal and a cancel signal.

In one embodiment the game leader input interface 304 comprises at least one button, wherein the button is visually diverting from the other parts of the game leader input interface 304

In one embodiment the button is configured as one of being brightly colored, physically protruding from the pit boss input interface (304) or shaped in a shape diverting from the general game leader input interface design.

In one embodiment the game leader input interface 324 comprises at least one button, wherein the button is visually diverting from the other parts of the game leader input interface 304

In one embodiment the button is configured as one of being brightly colored, physically protruding from the pit boss input interface (324) or shaped in a shape diverting from the general game leader input interface design.

In an example the game leader device's input interface (304) is activated that causes a first alert signal to be sent to a studio server (331). The studio server (331) receives a first alert signal, set the status of a gaming device (311) according to the alert signal, sends a third alert signal to the multiplayer server (410) and to send a fourth alert signal to a gaming sensor processor 313. The multiplayer server (410) is configured to receive a third alert signal, send a fifth alert signal to the game user device (260) and send a sixth alert signal to the game leader device 302.

Advantages

The system, method and program product of the present invention solves the problem that creating a network based live casino environment involves complex adaption and integration of the studio and control logic, which in prior art solutions must be repeated if additional network based non-live casino operators are to be supported by the same studio.

Another problem solved is that through the scalable solution any number of jurisdictions can be supported and integrated in a simple way.

Another problem solved is that the allocation of game users to gaming devices and casino operators are made dynamic.

An advantage with the system architecture is that game users, game devices and game servers are handled in a similar fashion, thereby allowing additional game users, game devices or game servers to be added without complex integration. This is made possible at the same time as game users associated with casino operators are provided with a casino operator specific experience, such as gaming device background, commercial offers and casino related information.

An advantage of the system, method and program product of the present invention is that reduced delay and reduce bandwidth requirements when switching between different visual aspects of game play is achieved.

The system, method and program product of the present invention solves the problem of supporting multiple game users associated with multiple casino operators by a single studio, comprising multiple micro studios with a content adapted to the game users association to a casino operator.

An advantage of the system, method and program product of the present invention is that the content presented to a game user is customized depending on the game users association to a casino operator. An example of this could be that a game user can e.g. be provided with a static background, dynamic background or animations adapted to a specific casino operator.

The system, method and program product of the present invention solves the problem of, whilst taking part in a network based live casino game on a first gaming device, taking part in or monitoring the progress of a network based casino game on a second gaming device.

The advantage of the system, method and program product of the present invention is that enabling the user to take part in multiple games The system, method and program product of the present invention solves the problem that a large amount of equipment resources must be allocated as at least one equipment unit has to be assigned to a gaming device for each casino operator associated to the gaming device.

The advantage of the system, method and program product of the present invention is that equipment resources are only allocated when a game user with an associated casino operator is allocated to a particular gaming device.

The system, method and program product of the present invention solves the problem that when recording audio associated with a gaming device in a micro studio, background noise such as sounds associated to other micro studios is also recorded. This results in degraded audio quality and reduced game user experience.

The advantage of the system, method and program product of the present invention is that background noise is reduced.

The system, method and program product of the present invention solves the problem of a high risk of erroneous entry when monitoring discrepancies between the physical live game play result and the result recorded by the control logic.

The advantage of the system, method and program product of the present invention is that the error probability when monitoring live casino game play in a network based live casino is reduced and a reduced amount of entries are required.

Increases the probability that an error in game play is noticed as multiple sources is monitoring game play and may alert if an error occurs.

Reduces repetitive procedures that becomes a natural response for the game leader which make him/her miss any errors.

The system, method and program product of the present invention solves the problem that parts of the energy used for lighting a micro studio environment heats up objects in the micro studio. This will put additional requirements on air conditioning facilities and increase the power consumption.

The advantage of the system, method and program product of the present invention is that energy is saved and heat generation is reduced in a micro studio environment. The reduced heat will also improve the climate and working conditions in a micro studio.

The invention claimed is:

1. A system for enabling network based live casino gaming, wherein a game user is enabled to participate from a remote location via a game user device in a live casino game operated by a casino operator, the system comprising:

a studio operably performing and recording live casino gaming;

a background screen operably reflecting light;

a gaming device;

one or a plurality of video recording devices communicatively coupled to an audio/video integration device, and a light emitting device, surrounding a video capturing sensor of the video recording device, wherein the light emitting device operably emits light with a wavelength within a first predetermined span onto the background screen, wherein one of the video recording devices is arranged to capture video images of the casino gaming device and of the background screen;

wherein the background screen operably reflects the emitted light from the light emitting device, and wherein the video recording device operably captures light reflected from the background screen, wherein after the captured light is captured by the video recording device, the captured light with a wavelength within the first predetermined span is calibrated by the video recording device, based on wavelengths of light, to obtain content with a wavelength within a second predetermined span.

2. The system of claim 1, wherein the studio comprises one or a plurality of micro studios, wherein said one or a plurality of micro studio comprises a background screen, a gaming device, one or a plurality of video recording devices and one or a plurality of microphones communicatively coupled to an audio/video integration device.

3. The system of claim 1, wherein said audio/video integration device operably performs audio/video integration functionality, wherein the audio/video integration device operably communicates integrated audio/video data to an audio/video data streaming provider data center via a communications network.

4. The system of claim 3, wherein the audio/video streaming provider data center operably receives live casino game audio/video data streams from said studio, for generating casino operator specific audio/video data streams by mixing said live casino game audio/video data streams with casino operator specific content, and for providing said generated casino operator specific audio/video data streams to the game user device.

5. The system of claim 1, wherein the background screen comprises glass beads that act as reflectors.

6. The system of claim 1, wherein the light emitting device comprises LED lights.

7. The system of claim 1, wherein the captured light with a wavelength within a first predetermined span generates content with pixels corresponding to light with a wavelength within the second predetermined span, based on wavelengths of light.

8. The system of claim 7, wherein the pixels corresponding to light with a wavelength within the first predetermined span is calibrated to pixels corresponding to light with a wavelength within the second predetermined span.

9. A method in a system for enabling network based live casino gaming, wherein a game user is enabled to participate from a remote location via a game user device in a live casino game operated by a casino operator, the method comprising:

emitting light with a wavelength within a first predetermined span onto a background screen, reflecting, by the background screen, the emitted light, capturing, by a video recording device, light reflected from the background screen, and after the video recording device captures the light, calibrating, by the video recording device, the captured light with a wavelength within the first predetermined span into content with a wavelength within a second predetermined span, based on wavelengths of light.

10. The method of claim 9, wherein the screen comprises glass beads that act as reflectors.

11. The method of claim 9, wherein the light emitting device comprises LED lights.

12. A computer program product for enabling network based live casino gaming, wherein a game user is enabled to participate from a remote location in a live casino game operated by a casino operator, the computer program product comprising: computer program code portions configured to direct a processor to perform the steps and functions of:

emitting light with a wavelength within a first predetermined span onto a background screen, reflecting, by the background screen, the emitted light, capturing, by a video recording device, light reflected from the background screen, and after the video recording device captures the light, calibrating, by the video recording device, the captured light with a wavelength within the first predetermined span into light with a wavelength within a second predetermined span, based on wavelengths of light.

* * * * *